US008284003B2

(12) United States Patent
Klossek et al.

(10) Patent No.: US 8,284,003 B2
(45) Date of Patent: Oct. 9, 2012

(54) OPERATING ELEMENT HAVING IMPROVED TILTING HAPTICS

(75) Inventors: Artur Klossek, Windshausen (DE); Thilo Schultheis, Bad Neustadt (DE)

(73) Assignee: Preh GmbH (DE)

( * ) Notice: Subject to any disclaimer, the term of this patent is extended or adjusted under 35 U.S.C. 154(b) by 94 days.

(21) Appl. No.: 12/863,471

(22) PCT Filed: Dec. 9, 2008

(86) PCT No.: PCT/EP2008/010423

§ 371 (c)(1), (2), (4) Date: Aug. 5, 2010

(87) PCT Pub. No.: WO2009/089874

PCT Pub. Date: Jul. 23, 2009

(65) Prior Publication Data

US 2010/0288071 A1 Nov. 18, 2010

(30) Foreign Application Priority Data

Jan. 18, 2008 (DE) ..... 10 2008 004 909

(51) Int. Cl.
*H01H 9/00* (2006.01)

(52) U.S. Cl. ..... 335/205; 335/207

(58) Field of Classification Search ..... 335/205
See application file for complete search history.

(56) References Cited

U.S. PATENT DOCUMENTS

| | | | | |
|---|---|---|---|---|
| 3,631,272 A * | 12/1971 | Kirii et al. | ..... | 310/10 |
| 3,934,216 A | 1/1976 | Ward | | |
| 4,489,303 A * | 12/1984 | Martin | ..... | 338/128 |
| 4,853,630 A | 8/1989 | Houston | | |
| 5,406,040 A * | 4/1995 | Johnson | ..... | 200/6 A |

FOREIGN PATENT DOCUMENTS

| | | | |
|---|---|---|---|
| CH | 545555 | A | 1/1974 |
| DE | 3526852 | A1 | 3/1986 |
| DE | 4109544 | A1 | 9/1992 |
| DE | 19922638 | A1 | 11/2000 |
| DE | 102006002634 | A | 2/2007 |
| EP | 1302835 | A1 | 4/2003 |
| WO | 2004013803 | A2 | 2/2004 |
| WO | 2007009744 | A2 | 1/2007 |

OTHER PUBLICATIONS

International Search Report PCT/EP2008/010423; Dated Mar. 26, 2009.

F. Kohlrausch, et al. "Praktische Physik", B.G. Teubner Stuttgart, 1985, p. 402.

H. Fahlenbrach, et al. "Dauermagnete und ihre Anwendung in Betrieben", Carl Hanser Verlag 1965, pp. 18-23.

German Office Action of DE 10 2008 004 909.3 issued Sep. 5, 2008.

* cited by examiner

*Primary Examiner* — Elvin G Enad
*Assistant Examiner* — Lisa Homza
(74) *Attorney, Agent, or Firm* — Cantor Colburn LLP

(57) ABSTRACT

A control element for a motor vehicle including a control button, a bearing location for the control button located in a housing of the control element, an extension firmly connected with the control button, a first permanent magnet attached to the extension, and a second permanent magnet attached in the housing, where the permanent magnets form a permanent magnet pair, and unlike poles of the magnets face each other at a distance in a mid-position of the control button, wherein a magnetically conductive material is attached at least in some areas and circumferentially to the permanent magnet pair.

4 Claims, 3 Drawing Sheets

Prior Art

OPERATING ELEMENT HAVING IMPROVED TILTING HAPTICS

TECHNICAL FIELD

The present invention relates to a control element for a motor vehicle, in particular to a joystick that can be tilted in several directions, comprising a control button, a bearing location for the control button located in a housing of the control element, an extension firmly connected with the control button, a first permanent magnet attached to the extension, and a second permanent magnet attached in the housing, wherein the permanent magnets form a permanent magnet pair, and unlike poles of the magnets face each other at a distance in a mid-position of the control button.

BACKGROUND

Tilting control elements are used in motor vehicles where several functions can be executed by means of a single control element. Examples therefor include toggle switches for electric windows or electrically adjustable exterior mirrors, as well as joystick-like control elements for controlling an on-board computer. In this case, joystick-like control elements are understood to be such control elements that can be tilted in at least four directions, so that a menu in a display system associated with the control element can be addressed by means of the joystick-like control element. For a more pleasant operation and a tactile feedback of the actuation, a force that varies over the displacement, by means of which the user is advised that the switching process has been carried out, is required for operating the control element. In the known control elements, this force-path behavior is usually produced by one or more springs or cooperating permanent magnets, which additionally return the control element into a mid-position when the user releases it.

A control element, in particular a joystick with a tilting feel for a motor vehicle, is known from DE 10 2006 002 634 A1. The control element has a tiltably mounted lever with a primary and at least one secondary lever arm and at least one permanent magnet pair, wherein one magnet of a permanent magnet pair is arranged on a secondary lever arm and one magnet is stationarily disposed in the control element. In this case, unlike poles of the magnets face each other such that the control element is retained in a mid-position. The force behavior over the displacement of the control element in this case depends on the parameters: length of the secondary lever arm, strength of the permanent magnets, physical size of the permanent magnets and the size of the air gap between the magnets of a permanent magnet pair. The secondary lever arm, and thus, the entire lever, is retained in the mid-position by the force between the magnets. In order to tilt the primary lever arm, the user has to overcome a force. The counter-force which the user has to overcome in order to tilt the primary lever arm can be represented graphically, with the force for displacing the lever decreasing again after a force maximum has been overcome, rising again after an end stop has been reached. The behavior of the increase of force, decrease of force and re-increase of force, which the user of the control element is able to feel, is in this case called the feel of the control element.

BRIEF SUMMARY

The invention modifies the feel of a control element in such a way that the force-path behavior, that is, the feel of the control element, is specifically adjustable, and to realize this with minimal constructional effort and in a cost-effective manner.

The invention provides a magnetically conductive material being attached at least in some areas and/or circumferentially on a permanent magnet pair disposed in the control element. By forming a control element according to the invention, the possibility is provided of vitally influencing existing control elements with regard to their feel behavior with a minimal constructional effort and thus, cost-effectively. Thus, it is possible, in particular without modifying the existing magnets, to specifically influence the feel behavior with regard to the maximum force and the path for achieving this maximum force value. In particular, it is possible to vary the size of the maximum force and thus, the moment on the control element without changing the strength of the permanent magnets or their physical size. Moreover, the possibility is provided of significantly influencing the force-path behavior of the feel with minimal constructional effort and while maintaining the geometric dimensions of existing permanent magnet pairs.

The permanent magnet pairs are surrounded by a conductive material, either circumferentially in the case of a round design, or in the case of a flat, rectangular or square embodiment of the permanent magnets. In the jacket or the lateral extension of the permanent magnets, the outer magnetic field lines are concentrated more or less strongly, depending on the strength and magnetic conductivity of the jacket.

The jacket in the form according to the invention is composed of electrically conductive materials or rare earths, such as, for example $Sm_2Co_{17}$, $SmCo_2$ or NdFeW.

BRIEF DESCRIPTION OF THE DRAWINGS

The invention is explained in more detail below with reference to exemplary embodiments by means of diagrams and sketches. In the figures.

DETAILED DESCRIPTION

Figure 1A:
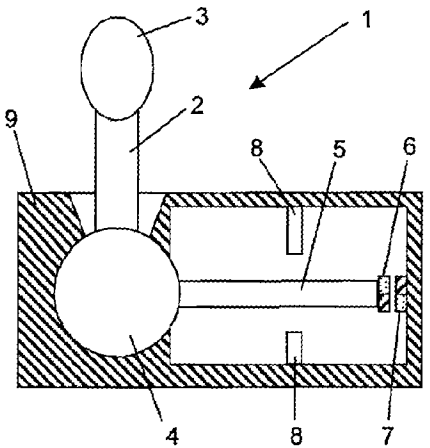
FIG. 1 shows a joystick-like control element known from the prior art.
Figure 1B:
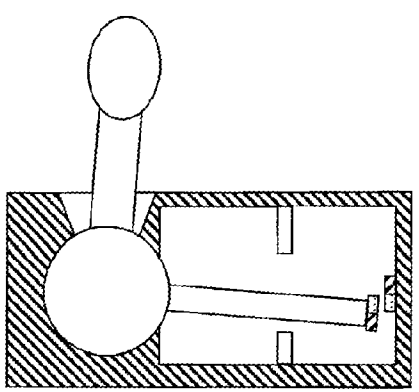

FIGS. 1*a*, 1*b* and is show a sectional side view of a control element 1 in three different operating positions according to the prior art. The housing 9 of the control element 1 has a recess in which a ball is disposed as a bearing location for a lever. The lever comprises a primary lever arm 2 and a secondary lever arm 5. One end of the lever arm 2 is firmly connected with the ball 4, the other end bears a handling member 3 in the shape of a control knob. With one end, the secondary lever arm 5 is firmly connected to the ball 4, the other end carries a permanent magnet 6. A second permanent magnet 7 is disposed in the housing 9 such that in the mid-position of the primary lever arm 2, there is an air gap between the magnet 6 and the magnet 7 and unlike poles of the magnets face each other. The end stops 8 delimit the freedom of movement of the secondary lever arm 5, and thus also of the primary lever arm 2.

Figure 2:
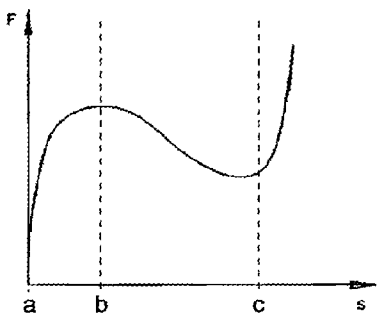
FIG. 2 shows a force-path diagram as a feel behavior of the force-path-line of the control element according to FIG. 1.

The secondary lever arm 5, and thus, the entire lever, is retained in the mid-position by the force between the magnets 6 and 7. In order to tilt the primary lever arm, the user has to overcome this force. The force F or the counter-force that the user must overcome for tilting the primary lever arm further is plotted against the displacement s of the primary lever arm 2 in FIG. 2. The sectional representation in FIG. 1*b* shows the control element 1 with a slightly displaced primary lever arm 2, with the position shown in FIG. 1*b* corresponding to the dashed line b from the force-path diagram of FIG. 2. The tilting movement of the primary lever arm 2 is transferred onto the secondary lever arm 5 via the ball 4. This movement of the lever arm 5 causes a relative movement of the magnets 6 and 7. In the position of the lever shown in FIG. 1*b*, the force required for further tilting the lever is greater than the force required for tilting the lever from the position shown in FIG. 1*a*. However, in the case of the displacement of the lever shown in FIG. 1*b*, the repulsive force between the north poles of the magnets 6 and 7 opposes the attractive force of the unlike poles of the magnets 6 and 7. This means that the force that the user has to exert in order to tilt the lever further decreases. This decrease of the restoring force provides the user with a tactile feedback that the switching process has been carried out, with the decrease of force from the Position B to the position C in FIG. 2 being referred to as Snap. Ideally, the drop of force or snap approximately corresponds to a third of the force that the user has to exert.

Figure 1C:
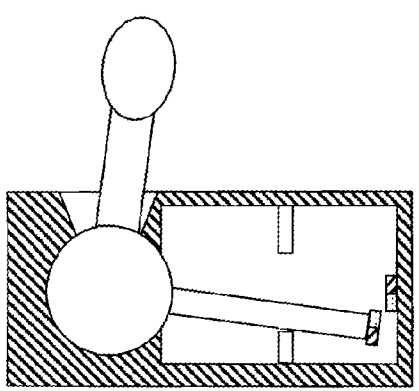

In the position of the lever shown in FIG. 1*c*, the secondary lever arm 5 rests against the end stop. Via the secondary lever arm 5 and the ball, the end stop 8 provides a delimitation of the tilting path of the primary lever arm 2. Preferably, the end stop 8 is configured to be elastic in order thus to prevent an abruptly increasing counter-force. Due to the low resilience of the material of the end stop, the counter-force increases quickly but steadily, as is shown in the run-out of the curve in FIG. 2.

Figure 3A:
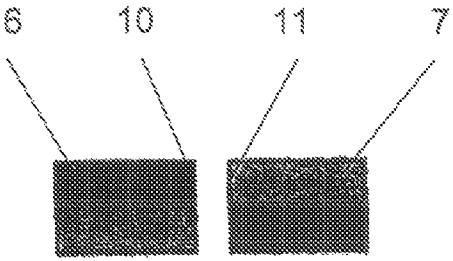
Prior Art Fig. 3a
FIG. 3*a* shows the arrangement of a permanent magnet pair according to the prior art.

In FIG. 3*a*, the permanent magnet pairs 6 and 7 are shown separate from the control element 1. The permanent magnet pairs include a north pole (dark grey) and a south pole (light grey). Opposite poles of the magnets have a different polarity so that the handling member 3 or control button 3 is retained in its mid-position. In this embodiment, the magnets are flat and configured to be square or rectangular, for example, at their opposing ends 10, 11.

Figure 3B:
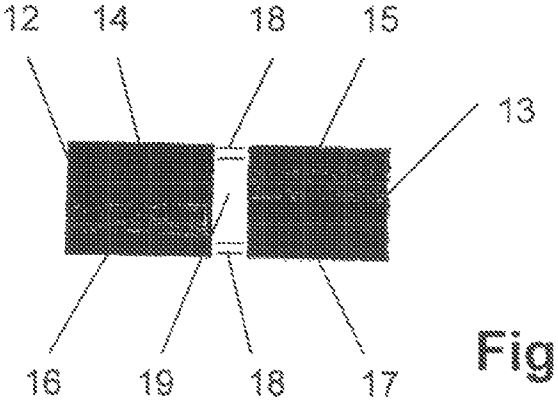
FIG. 3*b* shows the configuration of a permanent magnet pair according to the invention in a control element.

FIG. 3*b* shows a permanent magnet pair 12, 13 with metal sheets 14, 15, 16, 17 of a material that conducts the magnetic field lines disposed on both sides of the magnets 12, 13. The metal sheets 14, 15, 16, 17 or conductive linings 14, 15, 16, 17 cause an alignment and concentration of the magnetic field lines 18 surrounding the magnets 12, 13. The alignment and concentration of the magnetic field lines 18, according to the invention, enable an increase of the maximum force F without the use of expensive and large-volume permanent magnets. Depending on the configuration, material, thickness and number of the metal sheets 14, 15, 16 and 17 on the circumference of the permanent magnets 12, 13, a specific control of the force-path behavior and thus, the feel on the control element, is possible. Moreover, it is an advantage of the invention that an enlargement of the air gap 19 between the permanent magnets 12, 13 is made possible while maintaining the maximum force, which in turn facilitates assembly. Furthermore, it is also conceivable to use permanent magnets with smaller geometric dimensions, which in turn has a positive effect on the costs of the control elements.

In the embodiment shown in FIG. 3*b*, the permanent magnets 12, 13 are configured to be flat, so that the magnetically conductive metal sheets can be attached flat on the lateral ends of the permanent magnets 12, 13. If the permanent magnets 12, 13 are configured as circular permanent magnets 12, 13, then it is conceivable, according to the invention, to surround the permanent magnets 12, 13 completely and circumferentially with a magnetically conductive material. Providing the permanent magnets 12, 13 with a complete jacket can also be carried out, of course, if the permanent magnets 12, 13 are configured to be flat.

Figure 4:
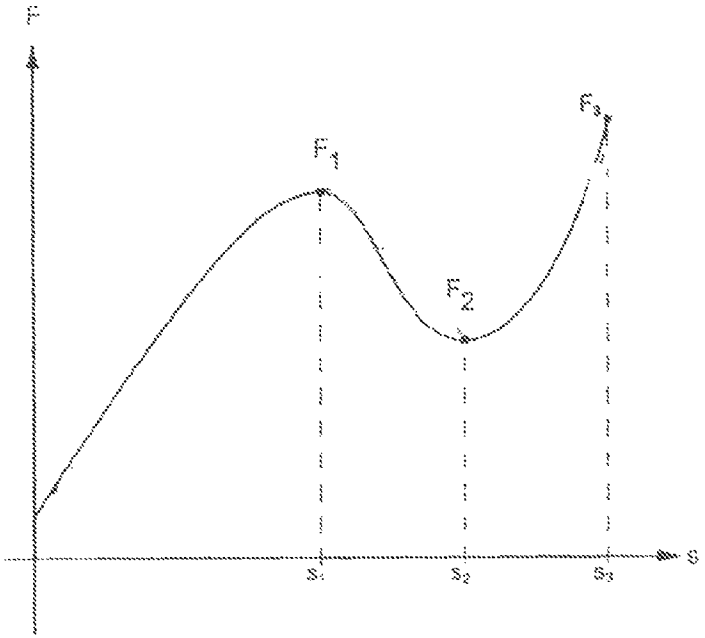
FIG. 4 shows the feel behavior of a control element as a function of force and path.

FIG. 4 shows a force-path diagram. Starting from a mid-position, a force is applied on the control element, which increases up to a certain point F1, 51, with this point F1, S1 corresponding to the force F1 and the path Sl, which corresponds to the maximum attractive force to overcome of the permanent magnets 12, 13 facing each other. As an example, a relative movement between the permanent magnets of S1=0.8 mm can be mentioned here. Once the maximum force F1 is overcome, the force drops down to a force F2 at the point S2, with like poles of the permanent magnets 12, 13 now facing each other, so that the control button would return to its mid-position from this position without an action by the user. The force in the diagram of FIG. 4 rises again after the point F2, S2 has been reached, up to reaching a force F3 after the path S3, with this point F3, S3 corresponding to reaching the end stop in the control element. The drop of force from F1 to F2 is ideally about one third of F1 and can be quantified with a value of 35% plus 10% minus 5%. In this case, F1 and S3 vary depending on application and feel to be adjusted or predetermined. As an example, a path of S3=1.5 mm can be specified for the path S3. The point of repulsion between the permanent magnets 12, 13 is not reached, so that the control button always returns automatically to its mid-position after actuation. The path S1 can be specified with 45 percent of S3 and a tolerance of plus 5% and minus 10%. The path S2 can be specified with S2=1.7×S1, with a tolerance of plus/minus 10% being possible.

Figure 5:
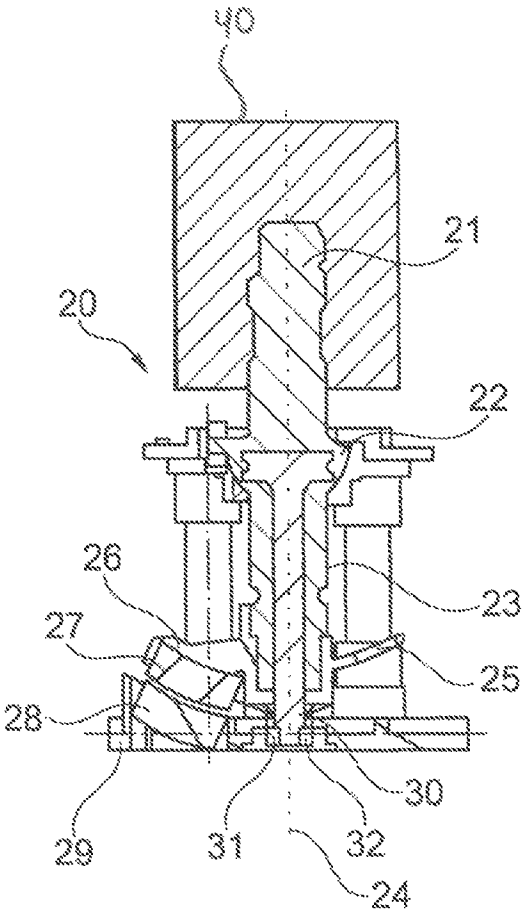
FIG. 5 shows an exemplary embodiment of a control element according to the invention.

A control element configured according to the invention with its essential components is sectionally represented in a side view in FIG. 5. The control element 20 has a primary lever arm 21, a bearing location 22 in the form of a ball-shaped bearing 22 for receiving a control button 40, a secondary lever arm 23, wherein the primary and the secondary lever arm 21, 23 are disposed above one another so as to be aligned in a center line or central axis 24. Cantilevers 25, 26 are attached on the secondary lever arm 23. A permanent magnet 27 cooperating with a permanent magnet 28 is attached to the cantilever 26, wherein the permanent magnet 28 is attached in a bottom part 29 of the control element 20 firmly connected to the housing of the control element 20 or forming a part of the housing. The permanent magnets 27, 28 form a permanent magnet pair 27, 28, wherein the poles of the permanent magnet pair 27, 28 facing each other are unlike, so that the lever arms 21, 23 are held in a mid-position. Preferably, two cantilevers 26, each with one permanent magnet 27, 28, are installed in the control element 20 offset by 90 degrees in the control element 20. The cantilever 25 is attached, offset by 180 degrees, to the secondary lever arm 23. The cantilever 25 cooperates with means for position acquisition and for detecting the path F of the displacement of the lever 23. The use of photosensitive or inductive sensors is conceivable in this case. In this exemplary embodiment, two cantilevers 25 are also attached, each offset by 90 degrees, to the secondary lever arm 23.

A pin 30, which cooperates with elastic end stops 31 and thus delimits the tilting movement of the lever 21, 23, protrudes from the secondary lever arm 23. The movement of the pin 30 in the direction of the end stop 31 corresponds to the path S3 of approx. 1.5 mm. As is clearly apparent from FIG. 5 and the exemplary embodiment depicted therein, the permanent magnets 27, 28 are not displaced to the extent that repulsion of the poles of the permanent magnets 27, 28 facing each other occurs.

By incorporating the magnetically conductive materials according to the invention, such as metal sheets, it is possible on the one hand to increase the force maximum F1 and, at the same time, to reduce the path S1. Thick sheets reduce the maximum force F1, so that the path S1 becomes displaceable. It is thus possible to vary and adjust exactly the feel behavior, that is, the behavior of the feel curve from the force-path diagram. By using the magnetically conductive materials according to the invention, such as soft magnetic materials, electric sheets or rare earths on the permanent magnets 27, 28, the field lines are concentrated so that the maximum force can be increased by 50% to 100%.

Figure 6:
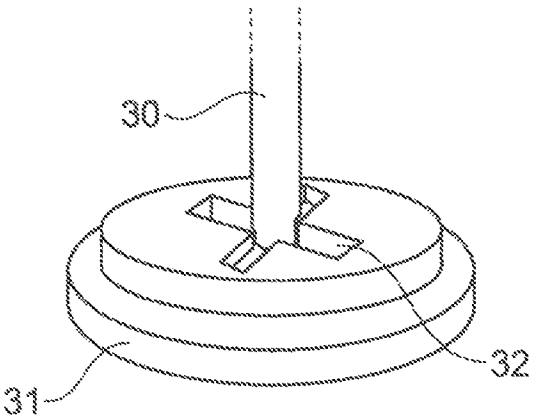
FIG. 6 shows a pin engaged with an end stop and a cross-shaped groove according to the invention.

The configuration of the elastic end stop 31 in the bottom part 29 of the control element 20 can also be used as a slotted guide 31. In this case, as seen in FIG. 6, the elastic element 31 would have, for example, a cross-shaped groove 32 in which the pin 30 is guided. A slotted guide, however, is required only to a limited extent because the use of the magnetically conductive materials around the permanent magnets 27, 28 ensure sufficient guidance.

As is described in the category-forming DE 10 2006 002 634 A1, the use of permanent magnet pairs is also suitable for the use of push keys. In this case, an extension is fitted, integrally or at least by force fit, to the control button, with a first permanent magnet being attached to the extension. A second permanent magnet is attached in the housing, wherein the permanent magnets form a permanent magnet pair, and unlike poles of the magnets face each other at a distance in an initial position of the control button of the push key, and a material conducting the magnetic field lines is additionally attached to the permanent magnet pairs. The force-path behavior of a push key substantially corresponds to that of a joystick-like control element (20), with only the control button and the extension executing a linear movement in the direction of the control element.

The invention claimed is:

1. Control element for a motor vehicle, comprising:

a control button, a bearing location for the control button located in a housing of the control element, an extension firmly connected with the control button, a first permanent magnet attached to the extension, and a second permanent magnet attached in the housing, wherein the permanent magnets form a permanent magnet pair, and unlike poles of the magnets face each other at a distance in a mid-position of the control button, wherein a movement of the control button effects a relative movement of the permanent magnets while generating a restoring force in direction to the mid-position, wherein the control button is attached to a primary lever arm, wherein a magnetically conductive material is attached at least in some areas and circumferentially to the permanent magnet pair, the magnetically conductive material being attached at least on each side of a pole of the permanent magnet, wherein the extension defines a secondary lever arm with two cantilevers that are respectively offset by 90 degrees relative to each other, each of said cantilevers with first permanent magnet being attached thereto, wherein the permanent magnets are configured to be flat.

2. Control element according to claim 1, wherein the primary and the secondary lever arm lie in an axis passing through the bearing location, wherein the primary lever arm protrudes from the housing for receiving the control button, wherein the axis forms a central axis.

3. Control element according to claim 1, wherein at least one cantilever with means for position recognition of the cantilever is provided.

4. Control element according to claim 1, wherein the bearing location is a ball joint.

* * * * *